United States Patent [19]

Aharonian

[11] Patent Number: 4,480,838

[45] Date of Patent: Nov. 6, 1984

[54] FAMILY FINANCIAL BOARD GAME

[76] Inventor: Aharon G. Aharonian, P.O. Box 67, Shrewsbury, Mass. 01545

[21] Appl. No.: 520,176

[22] Filed: Aug. 4, 1983

[51] Int. Cl.[3] ..... A63F 3/00

[52] U.S. Cl. ..... 273/256

[58] Field of Search ..... 273/256, 243, 146; 434/295

[56] References Cited

U.S. PATENT DOCUMENTS

| | | | |
|---|---|---|---|
| 4,030,210 | 6/1977 | Stebbins et al. | 434/295 |
| 4,279,422 | 7/1981 | Shaw | 273/256 |
| 4,382,602 | 5/1983 | Cusik et al. | 273/256 |

FOREIGN PATENT DOCUMENTS

| | | | |
|---|---|---|---|
| 515188 | 11/1939 | United Kingdom | 273/249 |
| 1432761 | 4/1976 | United Kingdom | 273/256 |
| 1443143 | 7/1976 | United Kingdom | 273/256 |

OTHER PUBLICATIONS

*Science Teacher*, Apr. 1973, p. 60.

"Extinction", *The Science Teacher*, Apr. 1973, p. 33.

*Primary Examiner*—Paul E. Shapiro

*Assistant Examiner*—Scott Brown

*Attorney, Agent, or Firm*—Louis Orenbuch

[57] ABSTRACT

This game entitled "Born Again" employs a board having a path on it formed by a sequence of divisions in which each division represents a period of a life-cycle beginning with birth. The life-cycle path is disposed within another path which is endless and contains blocks representing real estate or other property. Each player is given parents who are represented by tokens that move along the life-cycle track. Each player is represented by a Born Again token which is movable along the life-cycle path. The player is Born Again when the player throws the correct combination of chromosome symbols on a pair of chromosome dice. The player's family is represented by a family traveler token which is movable along the endless path in accordance with throws of standard dice. The game permits a player to acquire a spouse and raise a family. The spouse and other members of the family are represented by appropriate tokens.

5 Claims, 10 Drawing Figures

| AUGUSTA WING | PROVIDENCE WING | HARTFORD WING | BOSTON OCEAN VIEW | NEW YORK HARBOR VIEW | DOMESTIC FLIGHT | INTERNATIONAL FLIGHT | LOSE ONE TURN | |
|---|---|---|---|---|---|---|---|---|
| STANDARD | SUPERIOR | DELUXE | SUITE | PENTHOUSE | 50G | 70G | IN PARALYZING GRIP OF ROBOT "7-SLO" | HOUSE OF FATE |
| 100G | 120G | 170G | 170G | 190G | SUPER-TRON AIRLINE (120G) | | | |
| NORTHEASTERN STATES | | | | SUN-RISE HOTEL | | | | |
| 150G | 200G | 230G | 250G | 300G | 150G | 200G | | DIRECTION |
| 6 | 7 | 8 | 9 | 10 | 11 | 12 | 13 | 14 |

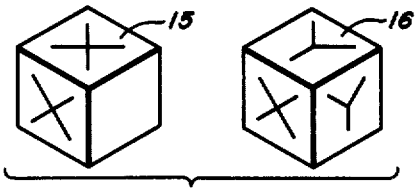

FIG. 4

YOU HAVE AN AUTOMOBILE ACCIDENT RESULTING IN STIFF NECK.
—— NOT YOUR FAULT ——
INSURANCE COMPANY SETTLES YOUR CLAIM
COLLECT $50,000

GOOD TIMES ARE HERE AGAIN

DRAW EXTRA 40% ON TOP OF REGULAR PAY. DISREGARD IF RETIRED

—— WAR ——
FULL SCALE WAR HAS BROKEN OUT. YOUR MOST EXPENSIVE PROPERTY UNIT HAS BEEN BOMBED AND SEVERELY DAMAGED. IT IS ONLY HALF INSURED. PAY THE NRB HALF THE LIST PURCHASE PRICE FOR REPAIRS.

ONE OF YOUR SISTERS PASSES AWAY FROM NATURAL CAUSES. (REMOVE HER SYMBOL) OUR SYMPATHIES TO YOU. PAY FUNERAL EXPENSES $5,000 (5G) DISREGARD IF YOU HAVE NO SISTER.

FIG. 5

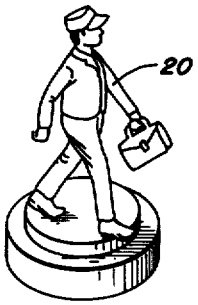

FIG. 6

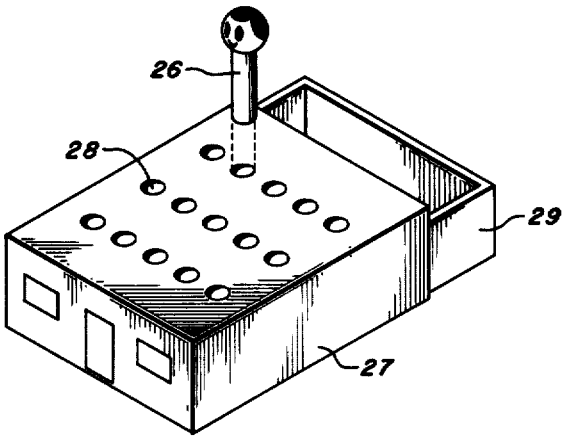

FIG. 7

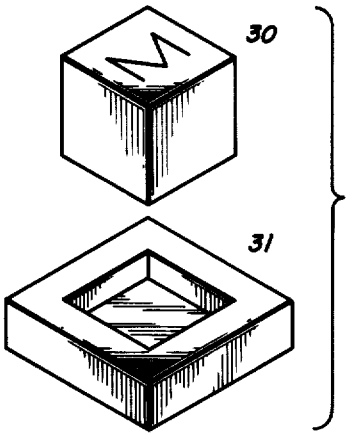

FIG. 8

FIG. 9

PARENTS' WORK: MAYOR / VICE MAYOR
START PARENTS TOKEN AT AGE FRAME 26 - 31 YRS.
PARENTS INCOME PER TIME FRAME $250,000 (250G)
IF ONE PARENT SHOULD DIE, INCOME IS
REDUCED PER TIME FRAME TO $125,000 (125G)
REMOVE PARENT TOKEN FROM THE BOARD
AT DEATH OR AT RETIREMENT.

PARENTS' WORK: AUTOMOBILE DEALERS
START PARENTS' TOKEN AT TIME FRAME 22 - 25 YRS.
PARENTS INCOME PER TIME FRAME $150,000 (150G)
IF ONE PARENT DIES, THE OTHER RECEIVES
FOR EACH REMAINING TIME FRAME $75,000 (75G)
REMOVE PARENT TOKEN FROM THE BOARD
AT DEATH OR AT RETIREMENT.

FIG. 10

SOCIAL WORKER

| COLLEGE DEGREE | YEARS OF STUDY | TUITION BOARD/ROOM | TIME FRAME DEGREE SALARY |
|---|---|---|---|
| BACHELOR'S | 4 | $32,000 | $55,000 (55G) |
| MASTER'S | 2 | $20,000 | $80,000 (80G) |
| DOCTORATE | 2 | $24,000 | $130,000 (130G) |

GIVE COUNSELLING AFTER GRADUATION

SYNTHETIC FUEL SCIENTIST

| COLLEGE DEGREE | YEARS OF STUDY | TUITION BOARD/ROOM | TIME FRAME DEGREE SALARY |
|---|---|---|---|
| BACHELOR'S | 4 | $40,000 | — |
| MASTER'S | 1 | $15,000 | $85,000 (85G) |
| DOCTORATE | 3 | $45,000 | $160,000 (160G) |

MAKE NEW FUEL AFTER GRADUATION

FAMILY FINANCIAL BOARD GAME

FIELD OF THE INVENTION

This invention relates in general to games of the type in which pieces are moved along a designated path on a board. More particularly, the invention pertains to board game apparatus in which one path is divided into time periods of a life-cycle and another path is employed for commercial dealings of a player's family.

BRIEF OVERVIEW OF THE INVENTION

The game is played on a board having two separate tracks. Players are "born again" into different families. Each of the families has a traveler who moves along an endless track which is divided into real estate and other properties with interposed Houses of Fate. While the players and their families pass through the different time periods of their lives from birth to retirement on the life-cycle track, the family travelers are traveling on the endless track seeking fortune for the family. During the journey along the endless track, properties can be bought and sold, rents can be collected, property can be mortgaged, and, in general, activities simulating commercial dealings are permitted.

The winner of the game is the player who forces the opponents to mortgage all board properties to the winner. The losers are not bankrupted inasmuch as one family property remains without a mortgage throughout the game. The players are not permitted to mortgage their family ranch houses. Consequently, regardless of the outcome of the competition to acquire property and money, the players can retire to the security of their family home.

THE DRAWINGS

FIG. 4 depicts the Born Again chromosome dice of the game apparatus.

FIG. 5 depicts four representative Fate cards.

FIG. 6 illustrates representative family traveler tokens of the apparatus.

FIG. 7 depicts a family ranch house piece which represents the family home in the game apparatus and one of the tokens representing an offspring is shown.

FIG. 8 shows a building piece which signifies a player's ownership of a real estate property and a tile representing a 2nd mortgage.

FIG. 9 shows a representative pair of 1st Generation cards.

FIG. 10 shows a representative pair of 2nd Generation cards.

DETAILED DESCRIPTION OF THE PREFERRED EMBODIMENT

Figure 1:
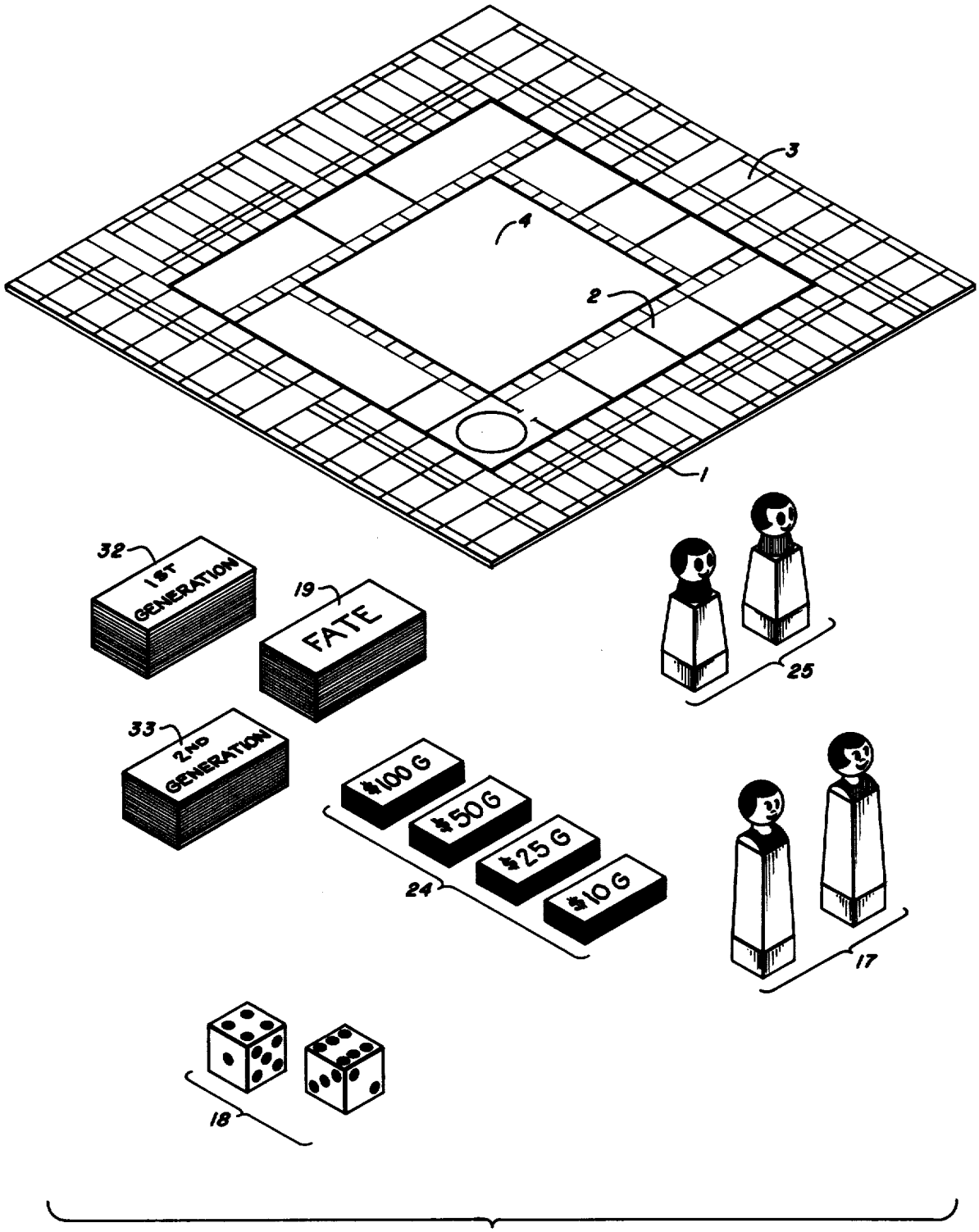
FIG. 1 is a perspective view of the board and other components of the game apparatus.

Referring now to FIG. 1, the game is played with a board 1 which is shown to have four sides to accommodate a maximum of four players. To accommodate more than four players, the board can be made in the shape of a pentagon, hexagon, etc. It is preferred to have all sides of the board of equal length and consequently the board 1 is a square. Obviously, the board can be made in other shapes without departing from the essence of the game.

Figures 2, 3:
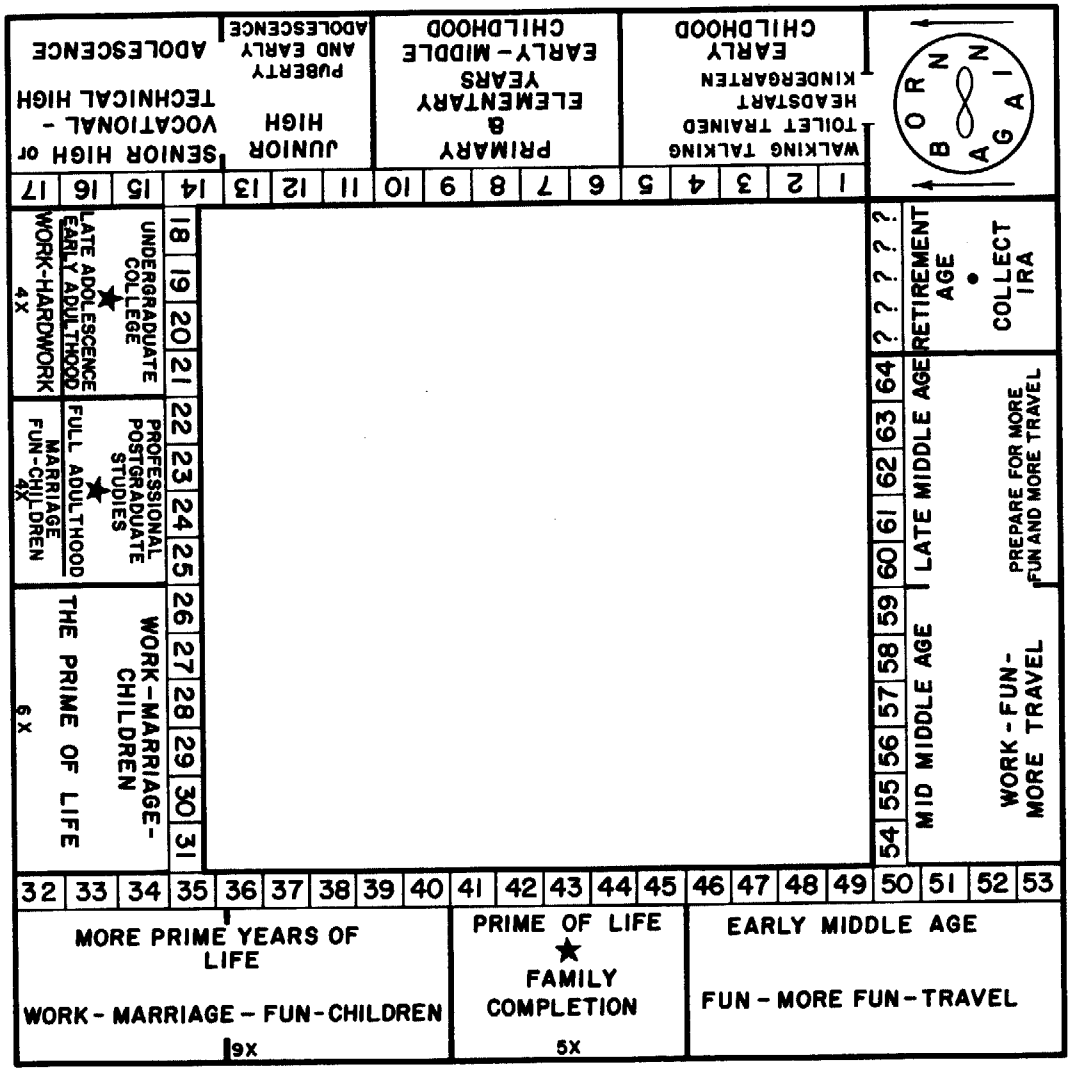
FIG. 2 is an enlargement of the life-cycle track on the board.
FIG. 3 is an enlargement of a part of the travel track on the board.

The board 1 has an inner time track 2 which is divided into divisions representing time periods in the life-cycle of a person. FIG. 2 is an enlargement of the life-cycle track which starts with a block 5 marked "Born Again." After being born again, the first period or time frame designated on the time track is "Early Childhood." Preferably, the years 1, 2, 3, . . . are marked along the inner border of the track and each year is associated with a significant event, such as "walking" for the 1st year, "talking" for the 2nd year, "toilet trained" for the 3rd year, etc. The next time frame designated on the time track is "Early-Middle Childhood"; that period covers the 6th to 10th years and is associated with "Primary & Elementary Schools." The next period is designated "Puberty, Early Adolescence, and Adolescence" and includes the 11th to 17 years which are associated with junior, senior, and vocational-technical high schools. The 18th to 21st years are designated "Late Adolescence, Early Adulthood"; that period is associated with "Undergraduate College" and with "Work-Hardwork." The next time frame is designated "Full Adulthood" and covers the 22nd to 25th years; that period is associated with "Professional Postgraduate Studies" and with "Marriage-Fun-Children." The next division is designated "The Prime of Life" and covers the period from the 26th to 31st years; that period is associated with "Work-Marriage-Children." The 32nd to the 40th years are designated "More Prime Years Of Life" and that period is associated with "Work-Marriage-Fun-Children." The next division is designated "Prime Of Life"; that division covers the 41st to 45th years and is associated with "Family Completion." The next period covers the 46th to 53rd years and is designated "Early Middle Age"; that period is associated with "Fun-More Fun-Travel." The next division designates the 54th to 59th years as "Mid-Middle Age" and associates that period witn "Work-Fun-More Travel." That same division also includes the 60th to 64th years which are designated "Late Middle Age" and are associated with "Prepare For More Fun And More Travel." The last division is designated "Retirement Age" and is associated with "Collect IRA." The term "IRA" is an abbreviation for "Individual Retirement Account." No period of years is indicated for the "Retirement Age"; rather ? marks are employed to indicate the uncertain extent of that period.

The time track 2 is surrounded, as indicated in FIG. 1, by a travel track 3. Preferably the time track 2 abuts the travel track and the time track forms a closed loop to take advantage of the space available around the periphery of the travel track. It is preferred to have a clear area 4 in the center of the board in which dice can be cast during playing of the game. To provide the maximum clear area, the time track abuts the travel track.

The travel track 3 is a square path that is divided into sequences of properties. Adjacent sequences of properties may be separated by a block labeled "House of Fate." In the illustrated example, there are eight sequences of properties and four Houses of Fate. The sequences need not be of equal length and the sequences may contain blocks that are free property and cannot be owned by any player.

FIG. 3 is an enlargement of a portion of the travel track shown in FIG. 1. In the enlarged view, blocks 6, 7, 8, 9 & 10, as a group, are designated "Northeastern States Sunrise Hotel." Block 6 is labeled "Augusta Wing," block 7 is labeled "Providence Wing," block 8 is labeled "Hartford Wing," block 9 is labeled "Boston Oceanview," and block 10 is labeled "New York Harborview." The type of hotel accommodation is indicated in the block by the term "Standard," "Superior," "Deluxe," "Suite," or "Penthouse." The type of hotel accommodation is also indicated by a color code on the block. "Standard" accommodations are indicated by blue, "Superior" accommodations are indicated by yellow, "Deluxe" accommodations by red, whereas "Suite" and "Penthouse" accommodations are indicated by green. That color code is used for all the hotel properties in the travel track. The price for which a property can be purchased is shown immediately above the name of the property. For example, in block 6, "100G" is the purchase price for that property. The figures at the lower edge of the blocks indicate the rent for the property. For example, the rent for the Augusta Wing is 150G. The term G stands for one thousand. All prices and rents are in thousands or multiples thereof.

In FIG. 3, blocks 11 and 12 are designated "Super-Tron Airline" and immediatedly below that name appears (120G). The amount in parentheses is the purchase price for both properties. The purchase price for each of those properties is indicated, as previously stated, immediately above the name of the property. Block 11 is designated "Domestic Flight" and its purchase price is 50G. Block 12 is designated "International Flight" and its purchase price is 70G.

The next block, block 13, is a free property and therefore is not available for purchase. A player landing on block 13 does not pay rent but loses one turn. For interest, block 13 bears the legend In Paralyzing Grip of Robot "7-SLO."

Block 14 is a House Of Fate. The arrow in that block indicates the direction of movement of the game pieces. There are four Houses Of Fate on the board, one on each side of the board. The Houses Of Fate serve as starting points of play for the family travelers. The travel track is divided into eight principal parts representing eight geographical regions of the United States. The Southeastern States region includes the Virgin Islands and Puerto Rico. Preferably, two different regions with an intervening House Of Fate are disposed on each side of the board 1.

In the preferred embodiment of the board each region has eight blocks and the eight regions comprise the following properties:

1. The Northeastern States Sunrise Hotel; Super-Tron Airline; and Robot "7-SLO."
2. The Mid-Atlantic States Luxury Hotel; and the Mid-Atlantic Grand Casino.
3. The Southeastern States Hospitality Hotel; P-Nut Patch Way; and The Coqui Casino.
4. The Great Lakes States Paradise Hotel; Champion Airline; and In Hypnotic Trance with Personal Computer.
5. The Spirit of the Plains States Harvest Hotel; Stella's Sweet Shop; and Zippy Airline.
6. The Southcentral States Prosperity Hotel; Texas Oil; and The Black Hole.
7. The Rocky Mountain States Eldorado Hotel; and The Las Vegas Casino.
8. The Pacific States Rainbow Hotel; Jelly Bean Alley; and Alaska Oil. In the above listing, each hotel covers five blocks, the Mid-Atlantic and Las Vegas casinos each covers three blocks, the Coqui casino has two blocks, each airline has two blocks, Texas Oil and Alaska Oil each have two blocks; the remaining properties each have one block and are free properties.

Referring now to FIG. 4, the game apparatus includes a pair of special dice 15, 16 which are termed "Born Again" dice. One Born Again die is a male die and the other is a female die. Preferably, the male die is of light blue color and the female die is pink. The female die 15 has an X on three of its faces and is blank on the other three faces. The X denotes a female chromosome. Because in real life, the female's contribution to conception can only be an X chromosome, the female die only has X's or blanks. The male contribution to conception can be either an X chromosome or a Y chromosome. Consequently, the male die 16 has an X on two of its faces, a Y on another two of its faces, and the remaining two faces are blank.

When a female chromosome is paired with a female chromosome, the union results in a baby girl. The pairing of a female chromosome with a male chromosome results in a baby boy. Because attempts at conception are not always successful, the Born Again dice have blank faces to simulate odds against conception. On casting the Born Again dice, the combination of an X and a Y signifies the birth of a male child, the combination of an X and an X signifies the birth of a female child, and the casting of a blank means that conception did not occur. In playing the game, the first time a female player throws the combination of an X and an X she is born again. Similarly, the first time a male player throws the combination of an X and a Y he is born again. Earlier throws of the dice by the player may result in the birth of siblings of the opposite sex before the player is born again. When a male or female player is born again, a "Born Again" token representing the player is placed on the "Born Again" block 5 in time track 3. In FIG. 1, the Born Again player tokens are designated by reference numeral 17. The Born Again tokens are color coded to enable each player to be identified with a specific color.

Referring again to FIG. 1, the game apparatus further includes a pair of standard dice 18 having the usual numerical markings on their faces. The standard dice are used to determine the extent of movement of the family traveler along the travel track during game play. When the dice are thrown, their numerical total determines the number of blocks which the player's family traveler token is moved along the travel track. Whenever the dice are thrown and the same number turns up on both dice (i.e. "double dice"), the player picks a Fate card. In addition, when the family traveler lands on a House of Fate block in the travel track, the player must pick a Fate card. For those purposes, the game apparatus, as shown in FIG. 1, includes a pack 19 of Fate cards. Shown in FIG. 5 are four representative Fate cards. Each of those cards confers either a benefit or a penalty upon the player. Each card is marked "Fate" on one side and the benefit or penalty is specified on the other side.

In the playing of the game, each player is furnished with a family traveler token which moves along the travel track in accordance with throws of the standard dice. A representative family traveler token 20 is illustrated in FIG. 6. Inasmuch as the token represents a family, it is preferred that the token, as indicated in FIG. 6, employ a figure of distinctive shape and that the figure be mounted upon a heavy base to prevent the token from easily falling over. The family traveler figures, in addition, are of different colors to aid in making each token distinctive from the others.

Referring again to FIG. 1, the game apparatus includes play money 24 which preferrably is in the form of bills in denominations of thousands (G) and multiples thereof. In lieu of bills, the play money can be chips in which the color of the chip indicates its value.

The game apparatus further includes markers representing the parents of each player. In FIG. 1, the parent markers are indicated by reference numeral 25. The player's father is represented by one marker and the player's mother is represented by another marker. The parent markers are color coded to correspond with the color of the player's Born Again token 17. To enable the mother to be easily distinguished from the father, the mother marker has a pink scarf whereas the father marker has a blue scarf.

To represent offspring such as brothers, sons, sisters, and daughters, tokens are used. The token, for example as indicated by the token 26, in FIG. 7, may be a doll's head mounted on a post. To denote a male offspring, the token is colored blue; to denote a female offspring, the token is colored pink. When a brother, son, sister, or daughter is born, the appropriate token is placed on a family ranch house. A typical family ranch house 27 is shown in FIG. 7. The roof of the ranch house is provided with sockets 28 into which fit the posts of the offspring tokens. As a convenience for storing tokens, the ranch house is provided with a drawer 29. At the start of the game, each player is furnished with a ranch house for his family. The family ranch house always remains the property of the family and cannot be sold or taken away from the family.

In the game, a player's ownership of a hotel property is signified by a building block 30 placed on the property. The building blocks are color coded. Because each player is identified with a specific color, ownership of the property is immediately apparent. When the property is placed under a first mortgage, the block 30 is turned to display an M. As long as the property is not mortgaged, the block is placed with the M face down. Only the National Reserve Bank is permitted to loan money on a first mortgage.

In playing the game, players are allowed to loan money for second mortgages on hotel properties. To indicate that a player holds a second mortgage on a property, a color-coded 2nd mortgage tile is placed under the improvement block 30. As shown in FIG. 8, the 2nd mortgage tile 31 preferably has a depression in which the block 30 sits with its M face uppermost. The 2nd mortgage tiles are color coded to match the mortgagees other tokens. When a player's family traveler lands on a block on which that player holds a 2nd mortgage, that player does not pay any rent for that block.

Referring once again to FIG. 1, the game apparatus includes a pack 32 of First Generation cards, a pack 33 of Second Generation cards and a list of careers. The First Generation cards are selected from the face down fanned out pack 32 of cards. Each selected First Generation card states the income of the parents and the time frame for starting the parents' token on the time track. A representative pair of First Generation cards are shown in FIG. 9. To decide who receives parents first, the players throw the standard dice. The player throwing the highest number goes first. In the event of a tie, the tying players throw the dice until the tie is broken. Parents are chosen for each player by the player at the right. The first player takes the entire pack of First Generation cards, shuffles them, and places them face down and fanned out. The player at the right picks one card and hands it to the first player. The first player then reads to the group the kind of work the parents do, their annual income, and their starting location on the time track. The procedure is repeated for each of the other players until parents have been chosen for all the players. Each player retains his First Generation card throughout the game or until the parents die or are retired.

After each player receives a First Generation card, that player is given tokens representing his parents which are placed on the board 1 at the indicated starting location in the time track. The player is also given a ranch house on which to place the offspring as they are born and the player is given a family traveler token which is placed on a House Of Fate block. The board has four House of Fate blocks and the player is permitted to choose the one on which his family traveler token is placed.

Throughout the game the player manages the money of his parents, handles their transactions, makes decisions on their behalf, and moves his parents' markers along the time track. After the player is "Born Again" and obtains his own money he combines the money of his parents with his own.

After a player has been born again, at each turn the player advances his Born Again token one time frame. Just before the player enters the Late Adolescence Early Adulthood time frame, the player must state his decision to either attend college or to go to work. If the player elects to go to college, he must be able to pay the requisite cost of tuition, room, and board. If the player's finances are insufficient, the player must go to work to enable him to start earning money as soon as possible.

The player is given a list of careers from which he selects his vocation or profession. The list is divided into two parts; a list of professional careers which are open to those players who elect to go on to college and a list of vocations that are open to the other players. Upon making an election, the player is given the 2nd Generation card for his chosen vocation or profession. Representative 2nd Generation cards are shown in FIG. 10. Each 2nd Generation cards specifies a vocation or profession, at least one level of education, and the salary or income for that level. Where different levels of education are indicated on a card, the salary associated with each level of education may be listed. For example, the Social Worker card in FIG. 10 lists 3 different college degrees, the cost of education (including room and board) for each degree, and the salary associated with each level of college education.

The 2nd Generation cards are also used when a player gets married. Players may get married as soon as the player enters the time frame where the player starts to work and earn money. Each player chooses a spouse by picking a 2nd Generation card from the pack which is placed face down and fanned out. The player being married picks the card and the person identified on the card becomes the player's spouse. The career of that spouse is thereby eliminated as a choice for the other players. Thereafter, the spouse's highest salary designated on the card is added to the player's own salary. To signify that the player is married, a "spouse" token is attached to the player's Born Again token. For that purpose, either the Born Again token, the spouse token, or both, may have provisions to facilate their attachment. Upon being married, the player may then start to raise his own family.

The source of all money in this game is the National Reserve Bank. At the start of the game, one of the players may be appointed as Money Coordinator to take charge of The Bank's money and attend to transactions between the Bank and the players. The Money Coordinator (1) pays all salaries, incomes, retirement, and other monetary benefits due the players as the game proceeds, (2) collects money for tuition, expenses, and penalties, and (3) takes charge of the property units 30 and 2nd mortgage tiles 31.

Preferably, another player is appointed to take charge of the 1st Generation and 2nd Generation cards. Another player may be appointed to take charge of the offspring tokens 26 and another player may be appointed to take charge of the other tokens, markers, and family ranch houses.

In using the game apparatus, rules for playing a game with that apparatus are here set forth.

When a player is Born Again by throwing the appropriate combination of chromosome dice, the player places his Born Again token in the time track on the block marked Born Again. No salaries are paid until the player's Born Again token advances to the time frame for the 18 to 21st years. Upon entering the Late Adolescence Early Adulthood time frame, the player either collects pay for work or pays tuition for college. Upon entering the Full Adulthood time frame, the player either collects pay for work or pays additional college tuition; in this time frame, Master's and Doctoral degrees are acquired. On advancing into the time frames from the Prime of Life to Late Middle Age, each player gets paid as he enters each time frame. On reaching retirement age, each player collects pay for the last time and also receives 500G from his IRA. Each parent and each player's spouse that reaches the retirement age time frame collects his salary for the last time plus an additional 500G from his IRA. Upon reaching the retirement age time frame the appropriate tokens are taken off the board.

First Round Of Play

After all players have received parent and family traveler tokens, start with the original first player who threw the highest dice and who was first to be given parents. Do all the following in the order listed.

(1) Leave parent marker where first placed.

(2) Collect your parents' salary as designated on their card.

(3) Throw the "Born Again" dice the same number of times as there are years in the time frame. The number of times to throw the Born Again dice is also shown by the letter X with a number before it in the applicable time frame. For example, in the 18–21 time frame, you will notice a 4X which indicates you will have to throw the dice four times; in the 26–31 time frame a 6X for six times, etc. (You will at some point be "Born Again" with brothers and sisters. Ths will be explained in the section on "Being Born Again and Family Formation.") Assuming you are "Born Again" during the first round, you will be given a "Born Again" Token. Place it in the time track block marked "Born Again."

(4) Throw the 2 standard dice, add the total thrown. Move the family traveler the same total number of blocks on the travel track as shown on the dice. You may buy or pass up purchase of the property you land on. Buying property will be explained later.

Pick a FATE card whenever you throw a double dice. Read the instructions on the Fate card before you move the family traveler. Unless otherwise indicated by the card, carry out the instructions before you move the family traveler. If, after you move the family traveler, it lands on a House of Fate, you pick another FATE card.

All other players in their turn do the same per above.

Second Round Of Play (1) Advance parents' marker to the next time-frame.

(2) Assuming you were "Born Again" (in the first round), advance your Born Again token to the "Early Childhood" time frame.

(3) Collect parents' salary.

(4) Throw the "Born Again" dice the same number of times as there are years in the parents' new time frame. Receive Blue and Pink mini-markers for offspring born to your parents and put them on your ranch house.

(5) Throw the 2 regular dice as before. Pick a Fate card on double dice. Follow instructions on the card before moving your family traveler the total shown on the dice.

Subsequent Rounds (1) Advance both the parents' marker and your "Born Again" marker to the next time frames for each.

(2) Collect parents' salary. Later when you start work you will also collect your pay and the pay of your spouse when you get married.

(3) Throw the "Born Again" dice for your parents for each time frame thru age 45. That is the last time frame (41–45) that you throw the "Born Again" dice for your parents. After you have completed throwing the Born Again dice for the last time for your parents, you then add up the total number of offspring and pay 10G for each one to the NRB for child support expenses. There is a star in the 41–45 time frame to remind you to make the payment.

After you get married, if it is agreeable with all the players, you may throw the "Born Again" dice for yourselves. Again you can throw the dice only thru age 45. You have to pay 10G for each of your own offspring in time frame 41–45.

(4) Throw the 2 standard dice to move your traveler.

Option To Throw One Or Two Regular Dice

After all Generation I parents have reached Retirement, you have the choice at each turn of throwing only one or both of the standard dice according to what property units you want to reach for safety or to buy, or what other player's property you might want to avoid paying rent on.

The player to exercise this choice first shall be the one whose parent(s) reach retirement last with no parent of any other player left on the time track. This player shall have this choice in the same turn that her/his parent(s) are retired.

Being "Born Again" And Original Family Formation

After all the players have been given their parents' cards, parents' tokens, and family traveler markers, the first player throws the chromosome dice in an attempt to be Born Again.

The first time a female player throws an XX combination, she is "Born Again." The first time a male player throws an XY combination, he is "Born Again." Other throws of the chromosome dice may result in the birth of siblings who may be born before or after you are Born Again.

When a male or female player is Born Again they are given a "Born Again" token which they place in the "Born Again" block at the starting point of the time track on the gameboard. They are also given a blue or pink offspring insert to place among their brothers and sisters.

There is no limit to the size of the family. Your "mother" may have additional children thru age 45. If, by rare chance, you are not "Born Again" by the time your "mother" is 45, you may throw the Born Again dice as many more times as may be necessary beyond the usually allowed 5 times (5X) for that time frame.

As in real life, players can not decide for their parents how many children their parents will have. Players must throw the Born Again dice each and every year for their parents.

Playing Out Your "Born Again" Life - Generation 2

After you have received your "Born Again" token you can proceed into the other stages of this game. You can proceed to go to school, to go to college or work, handle your own money, participate in the competition for property, get married, have children or your very own, etc.

Except for the game variation that requires children, married players otherwise may decide to have no children, or put off having children until 5, 10, 15, or more years after marraiage. Married players may decide to have no children by simply not throwing the "Born Again" dice. Married players are allowed to throw the dice every year until 45. The choice is theirs.

Work/College Career - Generation II

In this game everyone completes high school or vocational school at age 17. Just before you move your token to the age 18 space you must tell (speak out) what your plans are, as far as going to work right away or whether you plan to go to college. If you plan to go to college, you need to check your parents' finances to see if they can afford to send you. There is a star in the 18-21 and 22-25 time frames to remind you to make your college payments promptly.

The first choice of career for work or college goes to the player who first reaches 18. If the player chooses to go to work and start earning money right away, his choice is restricted to those jobs that require only a high school or vocational education, such as barbering, hairdressing, boxing, carpentering, etc. The player must choose from the list of occupations that do not require a higher education. The player will then be given the card (a 2nd Generation card) for that occupation. No two players of the same generation can have the same occupation.

High School Or Vocational Trade School Careers

If a player decides to become an automobile mechanic she/he is given the card for that career. The card reads:

| Education | Time-Frame Income |
|---|---|
| Trade School | $65,000 (65 G) |

This means that after you complete your vocational-technical high school education at age 17, you move your "Born Again" token into the next time frame which is 18-21.

The Money Coordinator pays you 65G when you make that move. You get the same amount for each move you make later into each of the other time frames including the Retirement time frame.

Special Course Career

Or if a player chooses to become a fashion model, the card reads:

| Education | Years of Study | Tuition | Time-Frame Salary |
|---|---|---|---|
| Modeling School | 1 | $3,000 | $50,000 (50 G) |

This means after you have completed High School or Vocational School, you have to go to Modeling School for one year. So you advance your Born Again token into the 18-21 time frame. You first pay $3,000 (3G) for tuition. Then for that same time frame you draw $50,000 (50G) as your salary. You then draw 50G for each of the remaining time frames including the final Retirement time frame.

College/Professional Careers

If a player selects a college-based career from the list, he will be given the Generation 2 card for the occupation. It tells how many years the player has to go to college, the tuition, and the salary to be expected upon graduation.

For the player who decides to become a Computer Scientist, the card reads:

| College Degree | Years of Study | Tuition Board/Room | Time-Frame Degree Salary |
|---|---|---|---|
| Bachelor's | 4 | $32,000 | $65,000 (65 G) |
| Master's | 1 | 8,000 | 80,000 (80 G) |
| Doctorate | 3 | 30,000 | 125,000 (125 G) |

After you have completed high school, you move into the undergraduate college scene in the 18-21 time frame. You immediately pay $32,000 (32G) to the Money Coordinator for your tuition, etc. If you decide to work in your next move (to time frame 22-25) you draw a 65G salary from the National Reserve Bank as a Bachelor level Computer Scientist.

You need not go all the way to get your Doctorate, if you don't want to. This applies also to all other cards with more than one degree. You may stop at the Bachelor's or the Master's level, if you wish. There are exceptions such as the Physicians card, the Bachelor degree draws no salary. So you would not want to stop your education there in that situation.

If you go only through the Master's degee level (time frame 22-25), you pay $8,000 (8G) tuition, etc. You then draw the 80G salary for that and remaining time frames.

If you decide to go for your Doctorate, you pay $38,000 (38G) at one time when you first enter time frame 22-25 for professional postgraduate studies. At your next move to time frame 26-31, you draw a salary of $125,000 (125G) and for each of the remaining time frames.

Getting Married

Players may get married as soon as they enter the time frame where they start to work and earn money (right after completion of High School, Vocational School, or Higher Education).

They choose their own spouses by picking a Generation 2 card. The pack of Generation 2 cards shall be fanned out and placed face down on the table or hand-held face down and fanned out. A card is selected by the player getting married and the person identified on the card becomes the player's spouse. That spouse's highest salary as described on that card is added to your salary by the National Reserve Bank. You are also given a "spouse" token which you attach to your own magnetized Born Again figure. You are then officially and automatically married and authorized to have a family of your own and entitled to throw the Born Again dice to beget offspring.

The career of your spouse is automatically eliminated as a choice of those players coming up the line. For example, if your spouse is a mechanic another player may not select that as a career since it already has been taken.

Hotel Properties

There are eight hotels, one for each region of the country. Each hotel is made up of five units or facilities. Each facility is color coded on the travel track to indicate the type of accommodation provided. In accordance with the color code, Standard accommodations are blue, Superior accommodations are yellow, Deluxe are red, and Suite and Penthouse accommodations are green.

Acquiring Hotel Properties

1. Landing On An Unowned Unit: Blue, Yellow, Or Red (Standard, Superior, or Deluxe)

When your family traveler lands on any unowned Blue, Yellow, or Red hotel property unit, you have the right to buy it at the listed price which you pay to the National Reserve Bank (hereinafter NRB). The NRB then gives you your color-coded building piece. You place it on the gameboard hotel unit so that the letter M is out of sight on the bottom of the building piece. The building piece signifies your ownership of that property. You may not buy a property of another color during the same turn except under special circumstances explained later.

2. Landing On Green: (Suite or Penthouse)

If you should land on and buy the Washington, D.C. Penthouse (Green) in the Mid-Atlantic Luxury Hotel, you may also buy the Annapolis Suite (Green) during the same play. Or you may buy only the Penthouse if that is all you can afford. You may buy the other Green, the Suite, later at list whenever it is your turn again and when you might have enough cash to finance the purchase. In the meantime another player could come along and land on it and buy it. But that is something you will be unable to prevent as long as the property is still unowned when an opponent lands on it.

If you land on one Green and buy it, you may automatically then buy the other Green, if you wish. But if you land on one Green and do not buy it you may not buy the other Green during the same turn.

3. Trading Property Units:

You may trade with the other players whatever properties you own, setting the terms to suit yourselves. You may trade unit for unit only, or you may trade unit for unit plus some cash. When a trade is completed you show new ownership by replacing your opponent's color-coded property pieces with your own. The only time you cannot trade a property is when there is a first mortgage on it. The first mortgage must first be paid off to the NRB and then it can be traded.

4. Forced Buyouts Of Minority Owned Units By The Majority Owner:

If you own the majority or have an interest in the majority of the units (at least three out of the five units) in any hotel, you may buy out the other owner(s) who have an equity toehold in the property. If necessary, you may count as a part of your own majority (of at least 3 units), the units on which you hold a second mortgage. Holding such a mortgage on an opponent's unit(s) increases your leverage for takeover purposes.

For example:

(A) If you should happen to own both Greens and hold a second mortgage on the Deluxe Red, that entitles you to buy out the Yellow and Blue.

(B) If you should happen to own both the Suite and Penthouse Greens plus the Deluxe Red, giving you an outright majority ownership of 3 units, you may then buy out the Standard Blue and Superior Yellow facilities.

(C) You must offer the other owner(s) two times the list purchase price. For example, for the Yellow, Raleigh Superior facility of the MID-Atlantic Luxury Hotel which carries a list purchase price of 400G, you must offer 800G. Your opponent may not like the offer but can not refuse it and can not turn you down. This is called a forced buyout and it will often turn out to be necessary in order for you to obtain ownership of the whole hotel and entitle you to collect double the listed rent. On partially owned property you collect only listed rent.

(D) If two players own two units each in a hotel, they may not buy each other out through a forced sale. But they can trade or buy one another's units on a voluntary basis at whatever price is agreeable. If there is no agreement there is no sale.

Buying Unowned Units In The Same Hotel Without Necessarily Having To Land On Them If you own the majority units of any hotel, you may buy the other unowned units without having to land on them. You may buy one or two of them at one time but you must pay twice the original listed purchase price and it may be done only during your turn. Or you may buy them at the regular listed price when you land on them one-at-a-time.

Conditions For Buying At Auction By Co-Equal Owners (A) When there are 4 Co-Equal Owners with 1 Unit Each and the 5th Unit is Unowned.

(B) When there are 2 Co-Equal Owners with 2 Units Each and the 5th Unit is Unowned.

(C) When there are 2 Co-Equal Owners with 2 Units Each and the 5th Unit is Owned.

Under (A) and (B) any Co-Equal owner has the right to ask the NRB to auction the unowned unit with bidding starting at twice list.

Under (C) either of the Co-Equal owners has the right to ask the owner of the 5th unit to place his unit on the auction block with bidding to start at twice list. If the owner refuses, then the NRB has a mandate to conduct the auction beginning at two times list. This will give the winner of this auction majority ownership paving the way to a forced buyout of the other owner.

Non-Hotel Properties

There are also 3 Casinos, 2 Oil properties, and 3 Airlines. You may acquire these properties in any of the following ways.

(1) You may buy one unit at a time as you land on each unit.

(2) If you can afford it, you may buy the whole Airline, Oil, or Casino property of which the unit you land on is a part. The total cost is indicated at the bottom in parentheses.

(3) After you have bought one unit in a non-hotel property and have moved on you may not buy the other unit(s) at listed price unless you land there in subsequent plays.

(4) By paying twice the listed price you may buy an unowned unit without landing on it provided you already own a unit.

(5) You may also acquire these units as part of a property trade.

Non-Purchasable Properties

1. The Four Houses of Fate.
2. In the Paralyzing Grip Of The Robot 7-SLO. Lose One Turn.
3. P-Nut Patch Way. Plains, Georgia. Free Landing.
4. In Hypnotic Trance With Personal Computer. Lose One Turn.
5. Stella's Sweet Shop No. 2. Ride A Laser Beam To Destination Of Your Choice.
6. Black Hole. Lost In Space. Lose One Turn.
7. Jelly Bean Alley. Santa Barbara, California. Free Transit.

Rent

Whenever landing on a Hotel, Airline or Oilwell property, the player pays the prevailing going rate of rent at the time (either list or double) plus 5G for each offspring in the family. The amount of the rent is the same whether the property is mortgaged or not.

Example:

If a player with a family of 8 children lands on Blue Standard Augusta (Maine) Wing of the Northeastern States Sunrise Hotel which has a list rent of 100G for that unit, the total rent will be:

| | | |
|---|---|---|
| Basic List Rent Rate | = | 100 G |
| 8 children @ 5 G each | = | 40 G |
| Total Rent | = | 140 G |

If later the rent has doubled the total rent will be:

| | | |
|---|---|---|
| Double the Listed Rent | = | 200 G |
| 8 children @ 5 G each | = | 40 G |
| | | 240 G |

Note that when the rent doubles only the listed price is doubled. The rental rate of 5G for each child remains the same throughout the game. Children's rates are never doubled.

The only time a player does not pay 5G for each child is when the traveler lands in one of the Casinos.

Rent On Property Without A Mortgage

1. The owner keeps all the rent.
2. When a player owns only some of the units of a property the rent is as listed.
3. When a player owns all the units of any property:
   (a) The rent is at list until all the players on the time track are retired and have collected their IRA's.
   (b) After that, rent inflation takes hold and rents are doubled on any property (Hotel and Non-Hotel) that is fully owned by one player.
4. The owner keeps the whole rent if a player lands on an unmortgaged wing or unit of the hotel or other property even if the other units of that same property are mortgaged.

Rent On Property With A First Mortgage

The owner keeps half the collected money and hands over the other half to the NRB.

For Example: With the Augusta (Maine) Wing with a first mortgage

| | |
|---|---|
| Basic List Rent Rate = | 100 G |
| 8 children @ 5 G Each = | 40 G |
| Total Rent = | 140 G |
| One half of 140 G = | 70 G |
| You give the NRB | 70 G |
| You keep | 70 G |
| | 140 G |

Rent On Property With A Second Mortgage

The owner collects the rent as usual. Then the owner gives half of the rent to the NRB and gives half to the player who has equity (in this case a second mortgage) in the property.

For Example: With the Augusta (Maine) Wing with both a first and second mortgage

| | |
|---|---|
| Basic List Rent Rate = | 100 G |
| 8 (children) @ 5 G each = | 40 G |
| Total Rent = | 140 G |
| One Half of 140 G = | 70 G |
| Therefore: | |
| You give one half to the NRB = | 70 G |
| You give the other half to the opponent = | 70 G |
| who holds the 2nd mortgage on the unit | |
| Total = | 140 G |

Exception

The opponent who holds a second mortgage on any unit does not pay any rent when landing on it.

Mortgaging Property

First Mortgages

A first mortgage for one half the listed purchase price may be held only by the NRB. Only the bank may loan money on a first mortgage.

You may mortgage your properties unit by unit at one half the listed purchase price.

Whenever you mortgage a property unit, turn the color-coded property pieces over so that the letter M (standing for Mortgaged) shows. That represents a first mortgage held on that unit by the NRB.

Before allowing a second mortgage on any of a player's property units, first mortgages must first be taken by the NRB on all of that player's property units on the entire gameboard.

Second Mortgages

A second mortgage for the remaining half of the value of the listed purchase price may be placed with another player or players toward the settlement of indebtedness incurred by the owner of the property.

In this instance the player who holds the second mortgage places one of his color-coded mortgage tiles underneath the owner's piece that already has the "M" showing.

This arrangement will immediately show that the bank holds the first mortgage and the owner of the color-coded mortgage tile underneath holds the second mortgage.

Whenever any of your property units are mortgaged you may not buy new property. You must pay off the mortgages first before starting to buy again.

Mortgage Charges

On either first or second mortgages there is no set rate of interest charged. Instead, the interest and carrying charges are figured into the requirement that any property owner with a first mortgage must give half of the rent collected to the NRB.

Likewise, with a second mortgage the owner must give the other half of the rent to the holder of the second mortgage indicated by the color-coded mortgage piece.

Winning And Concluding The Game

The game is getting close to being finished when players start to put second mortgages on one another's property units.

To win as Grand Master or Grand Mistress you must impose your second mortgages on your opponents' properties and force the withdrawal of their family travelers from the gameboard.

A player is forced to withdraw her/his family traveler from the gameboard at the moment when all her/his property units have second mortgages. The player then gives her/his remaining cash to the player with the largest number of second mortgages on her/his property units. In a two player game, that ends the game and the winner is declared the Grand Master or Grand Mistress of the Travel Track.

In a three or four player game the first and second players to withdraw their family travelers remain in the game, collecting the rents on their properties from the other players and splitting the rent between the NRB and the second mortgage holder(s). One of the second mortgage holders at this point is rapidly becoming the prime candidate for winning the game.

If all your original properties are second mortgaged by your opponent and you are still indebted but have second mortgages on other players' properties, your opponent may take over your second mortgages on the other units in settlement up to the limit of your indebtedness. Whatever you own is used to pay off your debts.

Your opponent does this simply by replacing your color-coded mortgage pieces, if any, with her/his own color-coded mortgage pieces.

You have reached the position of Grand Master or Grand Mistress of the Travel Track when you have forced the Retirement of all your opponents' family travelers and your family traveler is the only one remaining on the board.

I claim:

1. Game apparatus comprising (a) a game board having an inner path disposed within an outer path, one of those paths having a sequence of divisions in which each division represents a period of a life-cycle beginning with birth, the other of those paths being endless and having at least one sequence of contiguous blocks in which each block represents a real estate or other property, (b) a plurality of 1st generation cards, each card identifying parents and their income, (c) a plurality of 2nd generation cards, each card specifying a vocation or profession, at least one level of education, and the salary or income for that level, (d) a plurality of fate cards, each card specifying a benefit or a penalty, (e) a plurality of chromosome dice, one die having on at least one face a symbol representing a female chromosome, the other die having a symbol representing a male chromosome on at least one face and the symbol representing the female chromosome on at least one other of its faces, (f) a plurality of tokens, each token representing a player and being movable along the life-cycle track, and (g) a plurality of pieces, each piece representing a family and being movable along the endless path.

2. Game apparatus according to claim 1, further comprising (h) a plurality of markers, each marker representing an offspring or a sib, and (i) a plurality of home pieces, each home piece representing a family home.

3. Game apparatus according to claim 2, further comprising (j) a plurality of pieces, each piece representing a parent and being movable in the life-cycle track.

4. Game apparatus according to claim 3, further comprising (k) a plurality of building pieces, each building piece representing ownership of a real estate property, and (l) a plurality of tiles, each tile representing a mortgage upon a property.

5. Game apparatus according to claim 4, further comprising (m) play money, (n) a list of careers specifying a plurality of vocations and professions, and (o) a plurality of dice, each die having numerical values marked upon its face.

* * * * *